US009273566B2

(12) United States Patent
Spangler et al.

(10) Patent No.: US 9,273,566 B2
(45) Date of Patent: Mar. 1, 2016

(54) TURBINE ENGINE VARIABLE AREA VANE

(75) Inventors: Brandon W. Spangler, Vernon, CT (US); Tracy A. Propheter-Hinckley, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 821 days.

(21) Appl. No.: 13/531,001

(22) Filed: Jun. 22, 2012

(65) Prior Publication Data

US 2013/0343873 A1 Dec. 26, 2013

(51) Int. Cl.
*F04D 29/54* (2006.01)
*F01D 17/16* (2006.01)

(52) U.S. Cl.
CPC ..... *F01D 17/162* (2013.01); *F05D 2260/202* (2013.01)

(58) Field of Classification Search
CPC ..... F01D 17/162; F05D 2260/202
USPC ..... 415/208.2
See application file for complete search history.

(56) References Cited

U.S. PATENT DOCUMENTS 4,193,738 A * 3/1980 Landis et al. ..... 415/115
4,314,791 A 2/1982 Weiler
5,184,459 A * 2/1993 McAndrews ..... 60/226.3
5,931,636 A 8/1999 Savage et al.
6,210,106 B1 4/2001 Hawkins
7,845,906 B2 12/2010 Spangler et al.
7,857,588 B2 12/2010 Propheter-Hinckley et al.
8,007,229 B2 8/2011 McCaffrey et al.
8,105,019 B2 * 1/2012 McCaffrey et al. ..... 415/160
8,171,978 B2 5/2012 Propheter-Hinckley et al.
8,182,208 B2 5/2012 Bridges, Jr. et al.
8,202,043 B2 * 6/2012 McCaffrey ..... 415/160
2009/0097966 A1 4/2009 McCaffrey
2009/0148282 A1 6/2009 McCaffrey
2010/0202873 A1 * 8/2010 Andrew ..... 415/116
2011/0262274 A1 10/2011 Boy et al.

OTHER PUBLICATIONS

International search report for PCT/US2013/037618 dated Feb. 7, 2014.

* cited by examiner

*Primary Examiner* — Dwayne J White
*Assistant Examiner* — Jason Fountain
(74) *Attorney, Agent, or Firm* — O'Shea Getz P.C.

(57) ABSTRACT

A turbine engine stator vane is provided that rotates about an axis, and includes an airfoil, a flange and a shaft. The airfoil extends axially between a first airfoil end and a second airfoil end. The airfoil includes a concave side surface, a convex side surface and a cavity. The concave and the convex side surfaces extend between an airfoil leading edge and an airfoil trailing edge. The cavity extends axially into the airfoil from a cavity inlet in an end surface at the second airfoil end. The flange is connected to the second airfoil end. The flange extends circumferentially around at least a portion of the cavity inlet, and radially away from the concave and the convex side surfaces to a distal flange edge. The shaft extends along the axis, and is connected to the second airfoil end.

20 Claims, 6 Drawing Sheets

TURBINE ENGINE VARIABLE AREA VANE

This invention was made with government support under Contract No. FA8650-09-D-2923-DO 0013 awarded by the United States Air Force. The government may have certain rights in the invention.

BACKGROUND OF THE INVENTION

1. Technical Field

The present invention relates generally to a turbine engine and, more particularly, to a variable area vane arrangement for a turbine engine.

2. Background Information

A typical turbine engine includes a plurality of engine sections such as, for example, a fan section, a compressor section, a combustor section and a turbine section. One or more of the engine sections may include a variable area vane arrangement. Such a vane arrangement may be configured to guide and/or adjust flow of core gas between adjacent rotor stages within the respective engine section. Alternatively, the vane arrangement may be configured to guide and/or adjust flow of core gas between the respective engine section and an adjacent (e.g., downstream) engine section.

A typical variable area vane arrangement includes a plurality of rotatable stator vanes extending between an outer radial stator vane platform and an inner radial stator vane platform. Outer radial ends of the stator vanes are rotatably connected to the outer radial stator vane platform with an outer shaft and a bearing. Inner radial ends of the stator vanes are rotatably connected to the inner radial stator vane platform with an inner shaft and a bearing. The outer shaft may include a bore that directs cooling air from a plenum, adjacent the outer radial stator vane platform, into a cavity within an airfoil of the respective stator vane. Airfoil cooling apertures may subsequently direct the cooling air out of the cavity to film cool the outer surfaces of the airfoil that are exposed to the core gas. To provide a sufficient quantity of the cooling air, the outer shaft bore typically has a relatively large diameter. As the diameter of the outer shaft bore increases, however, the size of the bearing also increases, which may significantly increase the weight, cost and complexity of the vane arrangement.

SUMMARY OF THE DISCLOSURE

According to an aspect of the invention, a turbine engine stator vane is provided that rotates about an axis, and includes an airfoil, a flange and a shaft. The airfoil extends axially between a first airfoil end and a second airfoil end. The airfoil includes a concave side surface, a convex side surface and a cavity. The concave and the convex side surfaces extend between an airfoil leading edge and an airfoil trailing edge. The cavity extends axially into the airfoil from a cavity inlet in an end surface at the second airfoil end. The flange is connected to the second airfoil end. The flange extends circumferentially around at least a portion of the cavity inlet, and radially away from the concave and the convex side surfaces to a distal flange edge. The shaft extends along the axis, and is connected to the second airfoil end.

According to another aspect of the invention, a variable area vane arrangement is provided that includes a stator vane first platform, a stator vane second platform having a vane aperture, and a stator vane that rotates about an axis. The stator vane includes an airfoil, a flange, a first shaft and a second shaft. The airfoil extends axially between a first airfoil end and a second airfoil end, and includes a concave side surface, a convex side surface and a cavity. The concave and the convex side surfaces extend between an airfoil leading edge and an airfoil trailing edge. The cavity extends axially into the airfoil from a cavity inlet in an end surface at the second airfoil end. The flange is connected to the second airfoil end and seated within the vane aperture. The flange extends circumferentially around at least a portion of the cavity inlet, and radially away from the concave and the convex side surfaces to a distal flange edge. The first shaft extends along the axis, and is connected to the second airfoil end and is rotatably connected to the second platform. The second shaft also extends along the axis, and rotatably connects the first airfoil end to the first platform.

The flange may extend radially from the leading edge to the distal flange edge.

The airfoil may include one or more cooling apertures that respectively extend from the cavity to the concave side surface, the convex side surface, the leading edge and/or the trailing edge.

The airfoil may include a second cavity that extends axially into the airfoil from a second cavity inlet in the end surface. The flange extends circumferentially around at least a portion of the second cavity inlet.

The flange may extend axially from the end surface to a cooling channel surface, and includes a lip that extends substantially along the distal flange edge. A cooling channel is provided that extends radially between the airfoil and the lip adjacent to the cooling channel surface. In an embodiment, the vane aperture includes a semi-annular shelf with a seal surface, and the cooling channel extends axially between the seal surface and the cooling channel surface. In another embodiment, the vane aperture also includes a shelf lip that extends along an inner radial edge of the shelf and axially into the cooling channel from the seal surface. One or more cooling apertures may extend axially through the flange, and are fluidly coupled with the cooling channel.

The flange may extend circumferentially around the cavity inlet between a first tab seal surface and a second tab seal surface, and the shaft is located adjacent to and between the first and the second tab seal surfaces. In an embodiment, the shaft includes a notch that extends circumferentially around the axis between the first and the second tab seal surfaces, and the notch includes a semi-annular seal surface. In another embodiment, a seal with a semi-annular seal body is provided that extends circumferentially between a first tab and a second tab. The seal body engages the semi-annular seal surface, the first tab engages the first tab seal surface, and the second tab engages the second tab seal surface.

The shaft may be a solid shaft or a hollow shaft.

A vane actuation element may be connected to the flange. The actuation element extends axially from the end surface to a distal actuation element end adapted to connect to a vane actuator.

A fixed stator vane may be connected between the first platform and the second platform.

The first platform may be one of a plurality of arcuate segments of an annular stator vane first platform, the second platform is one of a plurality of arcuate segments of an annular stator vane second platform, and the stator vane is one of a plurality of stator vanes rotatably connected to the annular stator vane first platform and the annular stator vane second platform.

The foregoing features and the operation of the invention will become more apparent in light of the following description and the accompanying drawings.

DETAILED DESCRIPTION OF THE INVENTION

Figure 1:
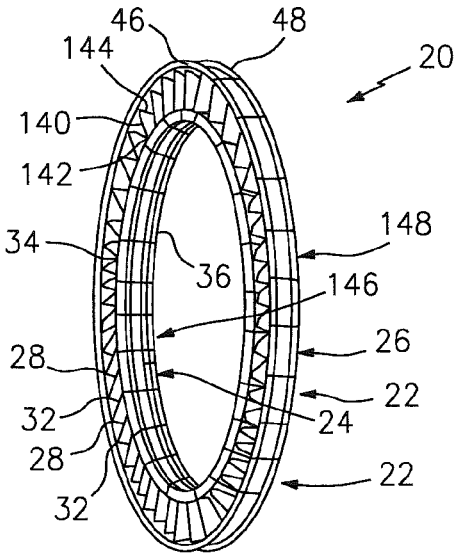
FIG. 1 is a perspective illustration of a variable area vane arrangement for a turbine engine.
Figure 2:
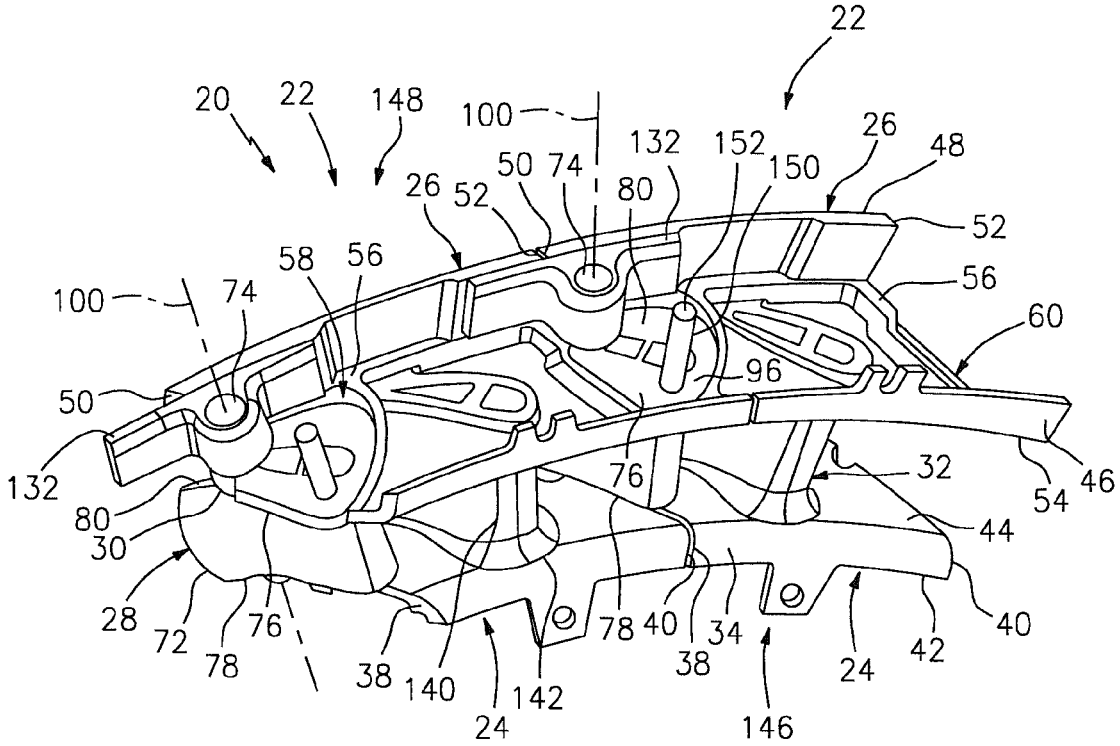
FIG. 2 is a perspective illustration of a section of the vane arrangement of FIG. 1.

FIG. 1 illustrates a variable area vane arrangement 20 for an engine section (e.g., a turbine section and/or a compressor section) of a turbine engine. FIG. 2 illustrates an enlarged section of the vane arrangement 20. Referring to FIGS. 1 and 2, the vane arrangement 20 may include a plurality of vane arrangement segments 22.

Referring to FIG. 2, one or more of the vane arrangement segments 22 includes a stator vane first platform 24 (e.g., an inner platform), a stator vane second platform 26 (e.g., an outer platform), at least one rotatable stator vane 28, and an apparatus 30 (e.g., a rotatable feather seal) for sealing a gap between the second platform 26 and the rotatable stator vane 28. One or more of the vane arrangement segments 22 may also include at least one fixed stator vane 32.

The first platform 24 extends longitudinally between a first (e.g., upstream) platform end 34 and a second (e.g., downstream) platform end 36 (see FIG. 1). The first platform 24 extends laterally and, for example, arcuately between a first platform side 38 and a second platform side 40. The first platform 24 also extends between a first (e.g., inner) platform surface 42 and a second (e.g., outer, gas path) platform surface 44.

The second platform 26 extends longitudinally between a first (e.g., upstream) platform end 46 and a second (e.g., downstream) platform end 48. The second platform 26 extends laterally and, for example, arcuately between a first platform side 50 and a second platform side 52. The second platform 26 also extends between a first (e.g., inner, gas path) platform surface 54 and a second (e.g., outer) platform surface 56.

Figure 3:
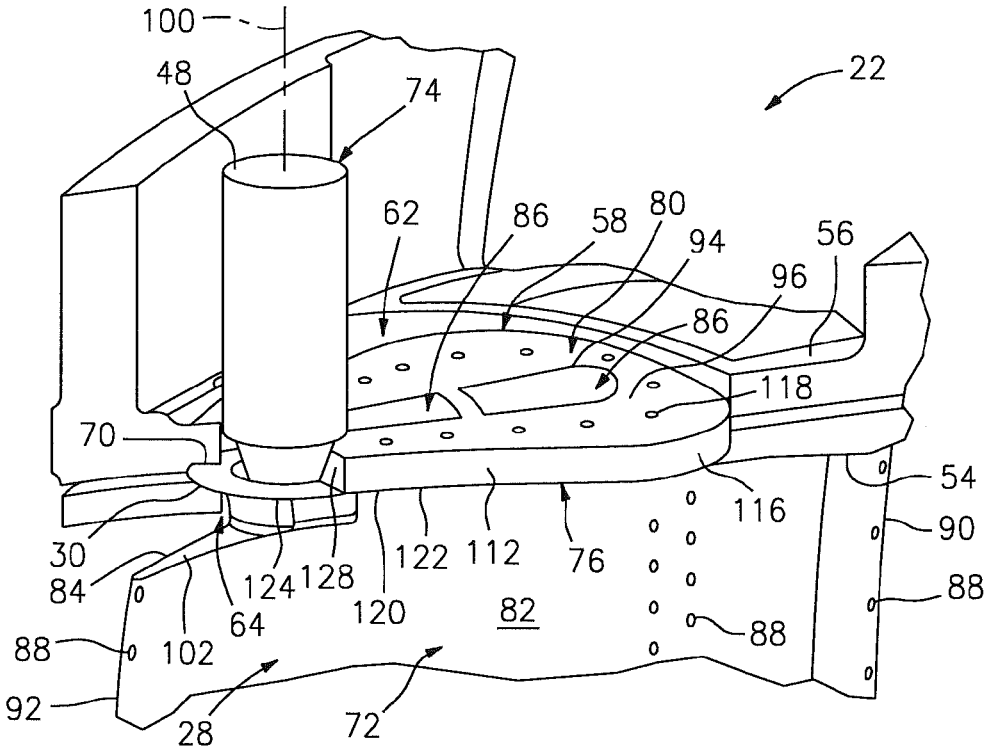
FIG. 3 is another perspective illustration of a section of the vane arrangement of FIG. 1.
Figure 4:
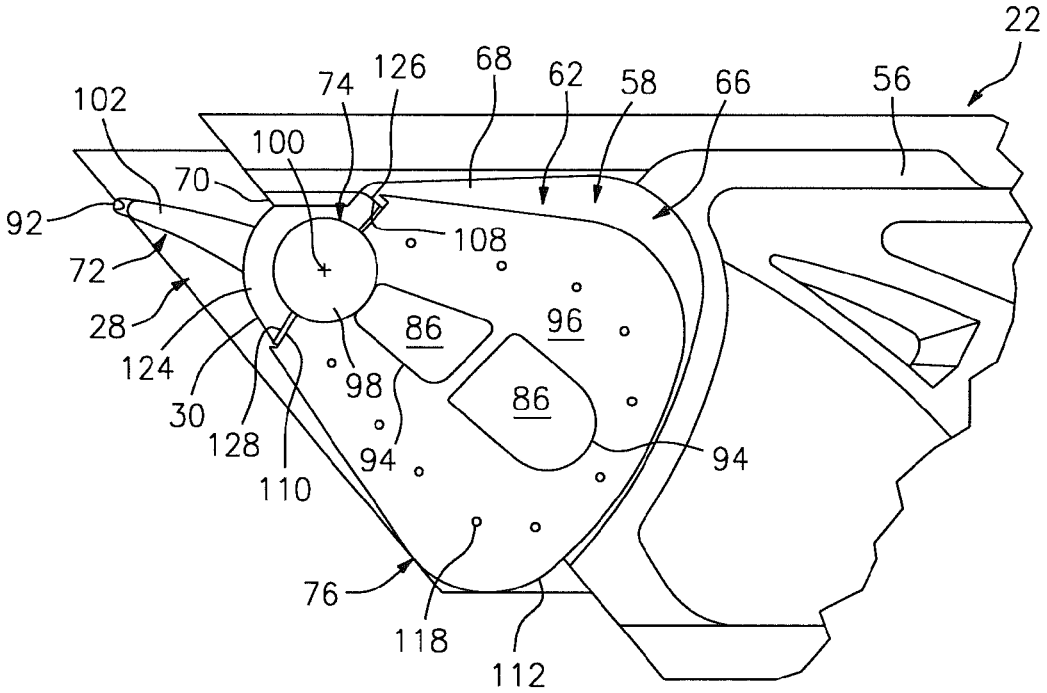
FIG. 4 is a top view illustration of the vane arrangement of FIG. 3.
Figure 5:
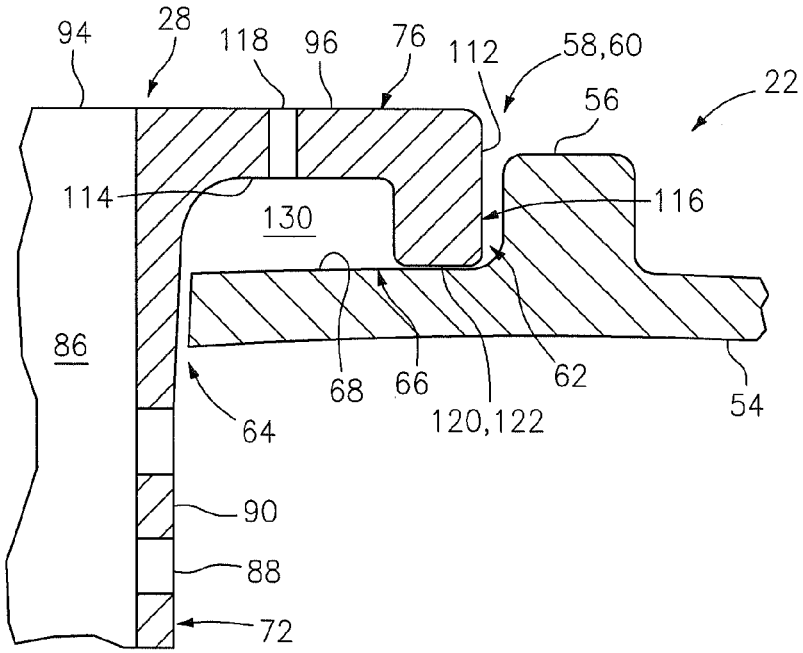
FIG. 5 is a side-sectional illustration of a section of the vane arrangement of FIG. 3.

The second platform 26 includes one or more vane apertures such as, for example, a first vane aperture 58 and a second vane aperture 60. The first vane aperture 58 may be located at the first platform side 50, and the second vane aperture 60 may be located at the second platform side 52. Each of the vane apertures 58, 60 extends from the second platform surface 56 to the first platform surface 54. Referring to FIGS. 3 to 5, for example, the first vane aperture 58 may include a first aperture segment 62, a second aperture segment 64, a semi-annular aperture shelf 66 with a substantially flat, semi-annular sealing surface 68, and a seal slot 70 (e.g., a feather seal slot). The first aperture segment 62 extends from the second platform surface 56 to the second aperture segment 64, which extends to the first platform surface 54. The aperture shelf 66 is defined at the intersection of the first aperture segment 62 and the second aperture segment 64. The seal slot 70 extends into a sidewall of the first vane aperture 58 and, for example, is substantially axially aligned with the aperture shelf 66. The second vane aperture 60 (see FIG. 2) may have a similar configuration to that of the first vane aperture 58. The second vane aperture 60, for example, may include a first aperture segment, a second aperture segment, a semi-annular aperture shelf with a substantially flat, semi-annular sealing surface, and a seal slot (e.g., a feather seal slot).

Figure 6:
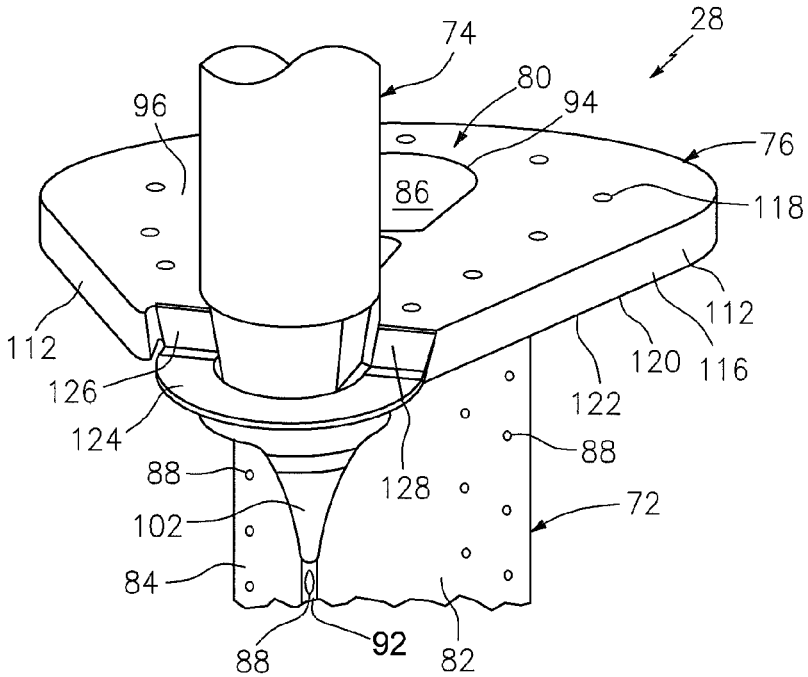
FIG. 6 is a perspective illustration of a section of a rotatable stator vane configured with a seal.
Figure 7:
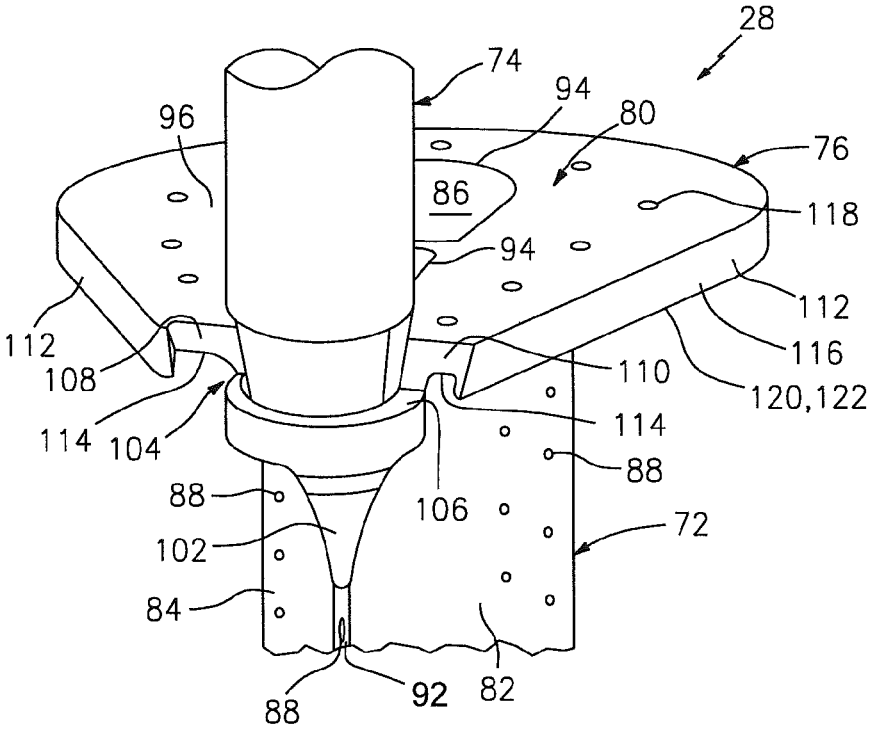
FIG. 7 is a perspective illustration of the rotatable stator vane of FIG. 6 without the seal.

The rotatable stator vane 28 includes a rotatable vane airfoil 72, a shaft 74 and a flange 76. Referring to FIG. 2, the rotatable vane airfoil 72 extends axially between a first (e.g., inner) airfoil end 78 and a second (e.g., outer) airfoil end 80. Referring now to FIGS. 3, 6 and 7, the rotatable vane airfoil 72 has a concave side surface 82, a convex side surface 84, one or more cavities 86, and one or more airfoil cooling apertures 88. The concave side surface 82 and the convex side surface 84 extend between an airfoil leading edge 90 and an airfoil trailing edge 92. Each of the cavities 86 extends axially into the airfoil 72 from a respective cavity inlet 94 towards the first airfoil end 78 (see FIG. 2). One or more of the cavity inlets 94 may be arranged in a first (e.g., outer) end surface 96 of the second airfoil end 80. The airfoil cooling apertures 88 respectively extend from the cavities 86 to the concave side surface 82, the convex side surface 84, the leading edge 90, and/or the trailing edge 92.

The shaft 74 is connected to the second airfoil end 80, and extends axially to a distal shaft end 98. The shaft 74, for example, extends along an axis 100 from a second (e.g., inner) end surface 102 of the second airfoil end 80 to the distal shaft end 98. The shaft 74 is located a first distance from the airfoil leading edge 90. The shaft 74 is located a second distance from the airfoil trailing edge 92 that is, for example, less than the first distance. Referring to FIG. 7, the shaft 74 may include a circumferentially extending notch 104 with a semi-annular seal surface 106.

The flange 76 is connected to the second airfoil end 80. The flange 76 extends circumferentially around at least a portion of one or more of the cavity inlets 94 between, for example, an axially extending first tab seal surface 108 and an axially extending second tab seal surface 110. The first tab seal surface 108 is located adjacent to a first end of the circumferentially extending notch 104. The second tab seal surface 110 is located adjacent to a second end of the circumferentially extending notch 104. The flange 76 extends radially from the concave side surface 82, the convex side surface 84 and, for example, the leading edge 90 (see FIG. 8) to a distal flange edge 112. The flange 76 may also extend axially from the first end surface 96 to a cooling channel surface 114.

Figure 8:
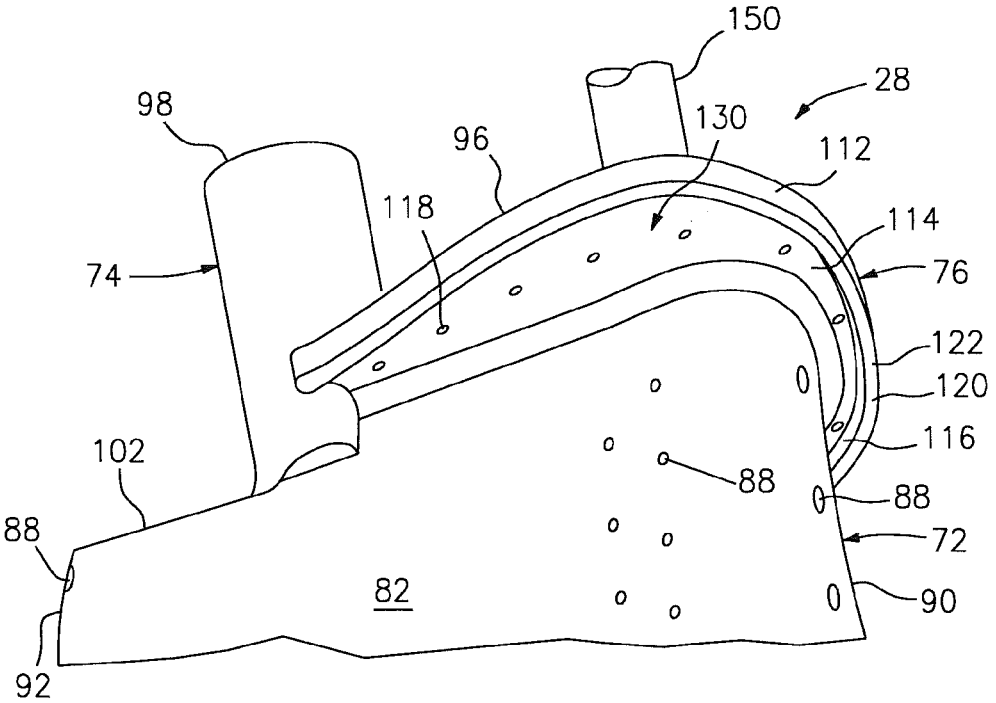
FIG. 8 is another perspective illustration of the rotatable stator vane of FIG. 6 without the seal.

Referring to FIGS. 5, 7 and 8, the flange 76 may include a flange lip 116 and/or one or more flange cooling apertures 118. The flange lip 116 extends along the distal flange edge 112, for example, between the first tab seal surface 108 and the second tab seal surface 110. The flange lip 116 also extends axially from the cooling channel surface 114 to a platform seal surface 120 at a distal lip edge 122. The flange cooling apertures 118 extend axially from the first end surface 96 to the cooling channel surface 114. The flange cooling apertures 118 may be arranged proximate the concave side surface 82, the convex side surface 84, and/or the leading edge 90.

Referring to FIGS. 6 and 7, the seal 30 includes a substantially flat, semi-annular seal body 124 that extends circumferentially between a first tab 126 and a second tab 128. The first tab 126 engages (e.g., sealingly connects to) the first tab seal surface 108. The second tab 128 engages (e.g., sealingly connects to) the second tab seal surface 110. The seal body 124 wraps partially around the shaft 74, and engages (e.g., sealingly connects to) the semi-annular seal surface 106.

Referring to FIGS. 3 to 5, the rotatable stator vane 28 is mated with the first vane aperture 58. The flange 76, for example, is seated in the first aperture segment 62 and the platform seal surface 120 engages (e.g., sealingly connects to) the sealing surface 68 of the aperture shelf 66. The seal body 124 is mated with (e.g., sealingly inserted into) the seal slot 70 to form a seal therebetween. Referring to FIGS. 5 and 8, a cooling channel 130 extends radially between the airfoil 72 and the flange lip 116. The cooling channel 130 extends axially between the sealing surface 68 and the cooling channel surface 114. The cooling channel 130 also extends circumferentially between the first tab 126 and the second tab 128 (see FIG. 6).

Figure 9:
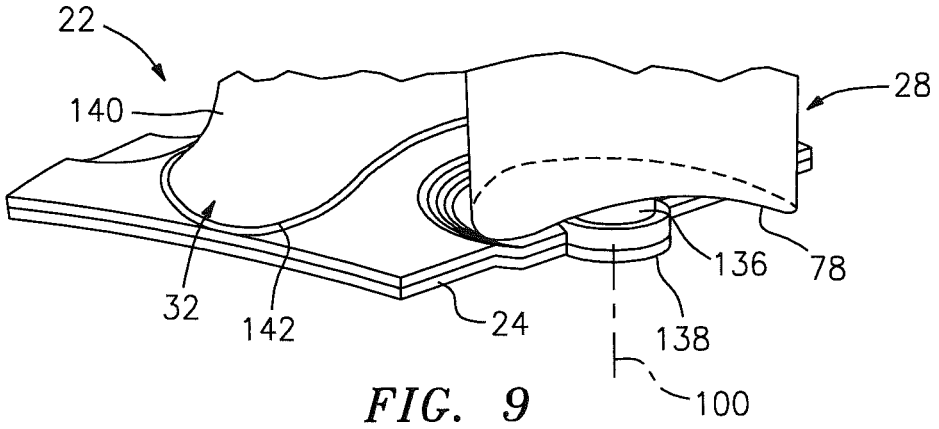
FIG. 9 is another perspective illustration of a section of the vane arrangement of FIG. 1.

Referring to FIG. 2, the rotatable vane airfoil 72 extends between and is rotatably connected to the first platform 24 and the second platform 26. The shaft 74, for example, is rotatably connected to the second platform 26 by a bearing 132 (e.g., a pillow block bearing, etc.). Referring to FIG. 9, a second shaft 136 connected to the first airfoil end 78 may be rotatably connected to the first platform 24 by a bearing 138 (e.g., a cartridge bearing, etc.). Examples of such rotatable connections are disclosed in U.S. Publication No. 2009/0097966, which is hereby incorporated by reference, and assigned to the assignee of the present invention. Examples of other types of rotatable connections are disclosed in U.S. Pat. Nos. 8,105,019 and 8,007,229, each of which is hereby incorporated herein by reference, and assigned to the assignee of the present invention. The present invention, of course, is not limited to any particular rotatable connection types and/or configurations between the rotatable stator vane 28 and the first and second platforms 24 and 26.

Referring to FIGS. 1 and 2, the fixed stator vane 32 includes a fixed vane airfoil 140 that extends axially between a first (e.g., inner) airfoil end 142 and a second (e.g., outer) airfoil end 144. The fixed vane airfoil 140 includes a concave side surface and a convex side surface, where both surfaces extend between an airfoil leading edge and an airfoil trailing edge (not shown). The first airfoil end 142 is fixedly connected to (e.g., integral with) the second platform surface 44 of the first platform 24. The second airfoil end 144 is fixedly connected to (e.g., integral with) the first platform surface 54 of the second platform 26.

Each of the vane arrangement segments 22 is connected between respective adjacent vane arrangement segments 22 to form the variable area vane arrangement 20. The first platform side 38 of each of the first platforms 24, for example, is connected to a respective second platform side 40 to form an annular stator vane first platform 146. Each of the rotatable stator vanes 28 is mated with a respective second vane aperture 60, for example, in a similar manner as described above with respect to the mating of the rotatable stator vane 28 with the first vane aperture 58. The first platform side 50 of each of the second platforms 26 is connected to a respective second platform side 52 to form an annular stator vane second platform 148.

The variable area vane arrangement 20 may be arranged, in some embodiments, between adjacent rotor stages (e.g., adjacent turbine or compressor stages) of the engine section. The variable area vane arrangement 20 may be arranged, in other embodiments, within the respective engine section adjacent another (e.g., downstream) engine section.

The rotatable stator vanes 28 may be respectively rotated about the axes 100 to guide gas through the variable area vane arrangement 20 according to a certain trajectory. The rotatable stator vanes 28 may also or alternatively be rotated to adjust flow of the gas through the variable area vane arrangement 20. Referring to FIGS. 3 to 5, each of the platform seal surfaces 120 may respectively maintain the seal with the sealing surface 68 of the aperture shelf 66 during the rotation. In addition, each of the seals 30 may respectively maintain the seals with the semi-annular seal surface 106 (see FIG. 7), the seal slot 70, and the tab seal surfaces 108 and 110. In this manner, the flange 76 and the seal 30 may significantly reduce and/or eliminate gas leakage through the gap between the rotatable stator vane 28 and the annular stator vane second platform 148 (see FIG. 2) during the rotation of the respective rotatable stator vane 28.

Figure 10:
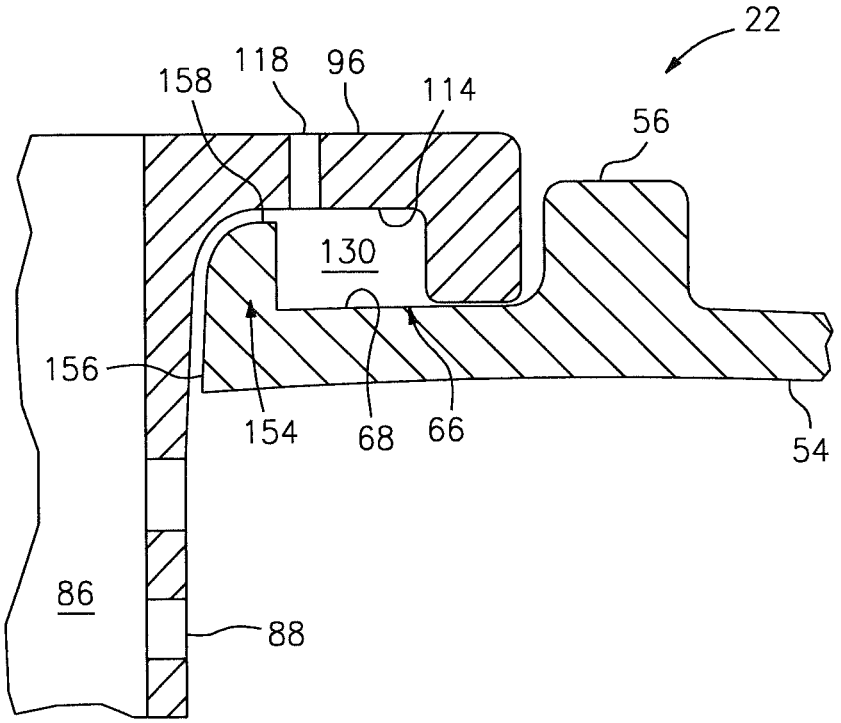
FIG. 10 is a side-sectional illustration of a section of an alternative embodiment variable area vane arrangement for a turbine engine.

The cavity inlets 94 respectively direct cooling air from a plenum adjacent the second platform surface 56 into the cavities 86. The airfoil cooling apertures 88 subsequently direct this cooling air out of the airfoil 72 to cool (e.g., film cool) the concave side surface 82, the convex side surface 84, the leading edge 90, and/or the trailing edge 92. When the rotatable stator vane 28 is rotated such that the gap between a wall of the second aperture segment 64 and the airfoil 72 is small (as shown in FIGS. 5 and 10), the flange cooling apertures 118 direct cooling air from the plenum into the cooling channel 130 to cool (e.g., impingement cool) the aperture shelf 66. This cooling air may subsequently leak through the gap and/or through film cooling holes (not shown) arranged in the aperture shelf 66 to cool (e.g., film cool) the first platform surface 54. As the rotatable stator vane 28 rotates in the opposite direction, the gap may become larger and the cooling channel surface 114 and/or the flange cooling apertures 118 may become exposed to the gaspath. In this instance, the flange cooling apertures 118 no longer provide impingement cooling to aperture shelf 66, but instead provide film cooling for surface 114.

Referring to FIG. 2, in some embodiments, one or more of the rotatable stator vanes 28 may include a vane actuation element 150 connected to a respective flange 76. The actuation element 150 may be configured as a cylindrical shaft, and extend axially from the first end surface 96 to a distal actuation element end 152. The distal actuation element end 152 is adapted to connect to a vane actuator (not shown) such as, for example, a unison ring. An example of a unison ring is disclosed in U.S. Pat. No. 8,092,157, which is hereby incorporated herein by reference, and which is assigned to the assignee of the present invention. The present invention, of course, is not limited to any particular type or configuration of vane actuation elements and/or vane actuators. In other embodiments, for example, the actuation element may be configured as a linkage arm connected to the distal end of the shaft 74.

Referring to FIG. 10, in some embodiments, the aperture shelf 66 may include a shelf lip 154 that extends along a distal shelf edge 156. The shelf lip 154 extends axially from the sealing surface 68 to a distal lip edge 158, which may be separated from the cooling channel surface 114 by a leakage gap.

A person of skill in the art will recognize the shape, size and number of one or more of the cavities, cavity inlets, airfoil cooling apertures and/or flange cooling apertures may vary depending upon the size and/or design of the variable area vane arrangement. In some embodiments, for example, some or all of the cavities within a respective airfoil may be interconnected. In other embodiments, the cavities within a respective airfoil may be fluidly discrete. In some embodiments, the cavity inlets, the airfoil cooling apertures and/or the flange cooling apertures may have elongated (e.g., rectangular, oval, elliptical, etc.) cross-sectional geometries. In other embodiments, the cavity inlets, the airfoil cooling apertures and/or the flange cooling may have circular cross-sectional geometries. In still other embodiments, the cavity inlets, the airfoil cooling apertures and/or the flange cooling may have flared geometries. The present invention therefore is not limited to the cavities, cavity inlets, airfoil cooling apertures and/or flange cooling apertures described above or illustrated in the drawings.

Figure 11:
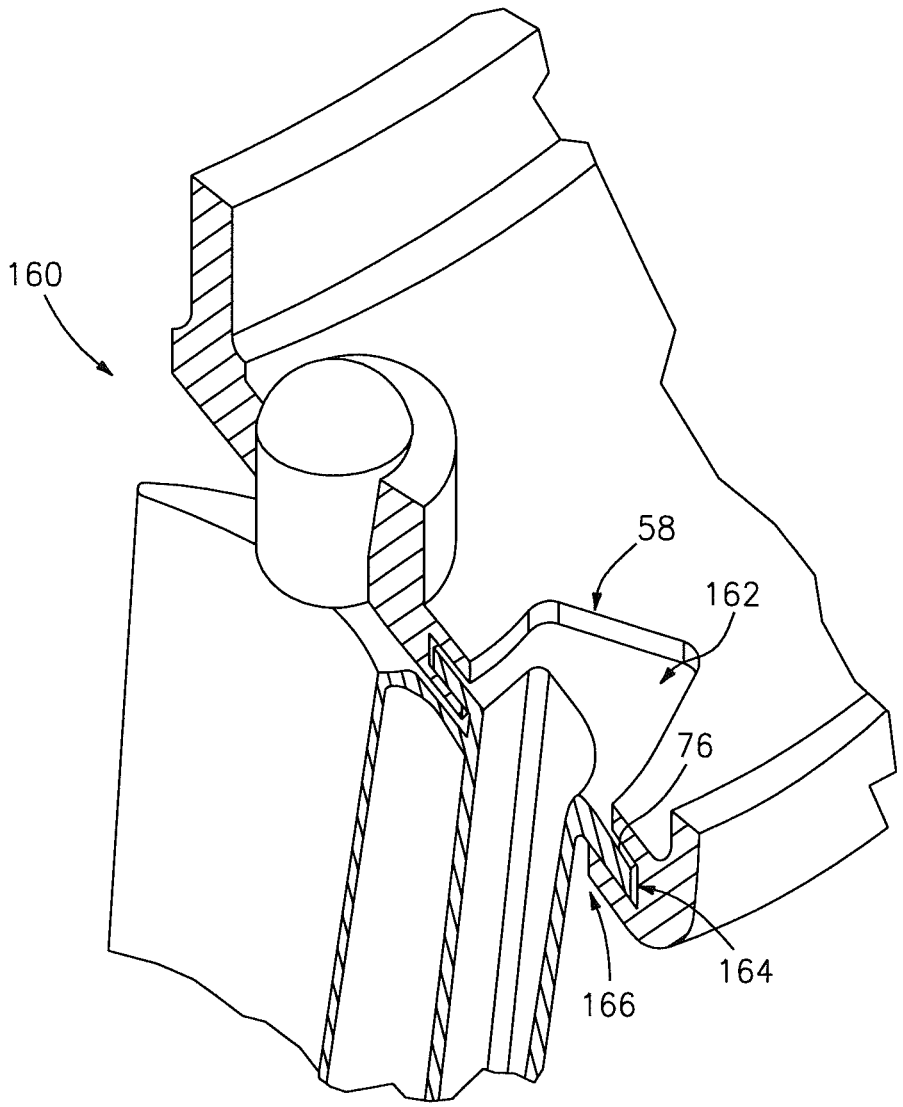
FIG. 11 is a perspective illustration of a section of another alternative embodiment variable area vane arrangement for a turbine engine.

FIG. 11 illustrates a section of an alternative embodiment vane arrangement segment 160. In contrast to the vane arrangement segment 22 of FIG. 3, each vane aperture 58, 60 of the vane arrangement segment 160 includes a first aperture segment 162, a second aperture segment 164 and a third aperture segment 166. The second aperture segment 164 defines a slot, between the first and third aperture segments 162 and 166, that receives the flange 76.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents.

What is claimed is:

1. A turbine engine stator vane that rotates about an axis, comprising:

an airfoil extending axially between a first airfoil end and a second airfoil end, and comprising a concave side surface, a convex side surface and a cavity, wherein the concave and the convex side surfaces extend between an airfoil leading edge and an airfoil trailing edge, and the cavity extends axially into the airfoil from a cavity inlet in an end surface at the second airfoil end;

a flange connected to the second airfoil end, wherein the flange extends circumferentially around at least a portion of the cavity inlet, and radially away from the concave and the convex side surfaces to a distal flange edge, wherein the flange has a non-circular cross-sectional geometry which lies in a plane that is perpendicular to the axis of the stator vane; and a shaft extending along the axis, and connected to the second airfoil end.

2. The stator vane of claim 1, wherein the flange further extends radially from leading edge to the distal flange edge.

3. The stator vane of claim 1, wherein the airfoil further comprises one or more cooling apertures that respectively extend from the cavity to at least one of the concave side surface, the convex side surface, the leading edge and the trailing edge.

4. The stator vane of claim 1, wherein the airfoil further comprises a second cavity extending axially into the airfoil from a second cavity inlet in the end surface, and wherein the flange extends circumferentially around at least a portion of the second cavity inlet.

5. A turbine engine stator vane that rotates about an axis, comprising:

an airfoil extending axially between a first airfoil end and a second airfoil end, and comprising a concave side surface, a convex side surface and a cavity, wherein the concave and the convex side surfaces extend between an airfoil leading edge and an airfoil trailing edge, and the cavity extends axially into the airfoil from a cavity inlet in an end surface at the second airfoil end;

a flange connected to the second airfoil end, wherein the flange extends circumferentially around at least a portion of the cavity inlet, and radially away from the concave and the convex side surfaces to a distal flange edge; and a shaft extending along the axis, and connected to the second airfoil end;

wherein the flange extends axially from the end surface to a cooling channel surface, and comprises a lip that extends substantially along the distal flange edge, and wherein a cooling channel extends radially between the airfoil and the lip adjacent to the cooling channel surface.

6. The stator vane of claim 5, further comprising one or more cooling apertures extending axially through the flange, and fluidly coupled with the cooling channel.

7. A turbine engine stator vane that rotates about an axis, comprising:

an airfoil extending axially between a first airfoil end and a second airfoil end, and comprising a concave side surface, a convex side surface and a cavity, wherein the concave and the convex side surfaces extend between an airfoil leading edge and an airfoil trailing edge, and the cavity extends axially into the airfoil from a cavity inlet in an end surface at the second airfoil end;

a flange connected to the second airfoil end, wherein the flange extends circumferentially around at least a portion of the cavity inlet, and radially away from the concave and the convex side surfaces to a distal flange edge; and a shaft extending along the axis, and connected to the second airfoil end;

wherein the flange extends circumferentially around the cavity inlet between a first tab seal surface and a second tab seal surface, and the shaft is located adjacent to and between the first and the second tab seal surfaces.

8. The stator vane of claim 7, wherein the shaft comprises a notch that extends circumferentially around the axis between the first and the second tab seal surfaces, and the notch comprises a semi-annular seal surface.

9. The stator vane of claim 8, further comprising a seal with a semi-annular seal body that extends circumferentially between a first tab and a second tab, wherein the seal body engages the semi-annular seal surface, the first tab engages the first tab seal surface, and the second tab engages the second tab seal surface.

10. The stator vane of claim 1, wherein the shaft comprises a solid shaft.

11. The stator vane of claim 1, further comprising a second shaft that extends along the axis, and is connected to the first airfoil end.

12. The stator vane of claim 1, further comprising a vane actuation element connected to the flange, wherein the actuation element extends axially from the end surface to a distal actuation element end adapted to connect to a vane actuator.

13. A variable area vane arrangement, comprising:

a stator vane first platform;

a stator vane second platform comprising a vane aperture; and a stator vane that rotates about an axis, the stator vane comprising an airfoil extending axially between a first airfoil end and a second airfoil end, and comprising a concave side surface, a convex side surface and a cavity, wherein the concave and the convex side surfaces extend between an airfoil leading edge and an airfoil trailing edge, and the cavity extends axially into the airfoil from a cavity inlet in an end surface at the second airfoil end;

a flange connected to the second airfoil end and seated within the vane aperture, wherein the flange extends circumferentially around at least a portion of the cavity inlet, and radially away from the concave and the convex side surfaces to a distal flange edge, and wherein the flange has a non-circular cross-sectional geometry which lies in a plane that is perpendicular to the axis of the stator vane;

a first shaft extending along the axis, wherein the first shaft is connected to the second airfoil end and is rotatably connected to the second platform; and a second shaft extending along the axis, wherein the second shaft rotatably connects the first airfoil end to the first platform;

wherein a gas path is formed between the first platform and the second platform, and wherein the second platform is disposed between the gas path and the flange.

14. The vane arrangement of claim 13, wherein the flange further extends radially from the leading edge to the distal flange edge.

15. The vane arrangement of claim 13, wherein the airfoil further comprises one or more cooling apertures that respectively extend from the cavity to at least one of the concave side surface, the convex side surface, the leading edge and the trailing edge.

16. A variable area vane arrangement, comprising:

a stator vane first platform;

a stator vane second platform comprising a vane aperture; and a stator vane that rotates about an axis, the stator vane comprising an airfoil extending axially between a first airfoil end and a second airfoil end, and comprising a concave side surface, a convex side surface and a cavity, wherein the concave and the convex side surfaces extend between an airfoil leading edge and an airfoil trailing edge, and the cavity extends axially into the airfoil from a cavity inlet in an end surface at the second airfoil end;

a flange connected to the second airfoil end and seated within the vane aperture, wherein the flange extends circumferentially around at least a portion of the cavity inlet, and radially away from the concave and the convex side surfaces to a distal flange edge;

a first shaft extending along the axis, wherein the first shaft is connected to the second airfoil end and is rotatably connected to the second platform; and a second shaft extending along the axis, wherein the second shaft rotatably connects the first airfoil end to the first platform;

wherein the vane aperture comprises a semi-annular shelf with a seal surface;

wherein the flange extends axially from the end surface to a cooling channel surface, and comprises a flange lip that extends substantially along the distal flange edge and is engaged with the seal surface; and wherein a cooling channel extends radially between the airfoil and the flange lip, and axially between the seal surface and the cooling channel surface.

17. The vane arrangement of claim 16, further comprising one or more cooling apertures extending axially through the flange, and fluidly coupled with the cooling channel.

18. The vane arrangement of claim 16, wherein the vane aperture further comprises a shelf lip that extends along an inner radial edge of the shelf and axially into the cooling channel from the seal surface.

19. The vane arrangement of claim 13, further comprising a fixed stator vane connected between the first platform and the second platform.

20. The vane arrangement of claim 13, wherein the first platform is one of a plurality of arcuate segments of an annular stator vane first platform;

the second platform is one of a plurality of arcuate segments of an annular stator vane second platform;

the stator vane is one of a plurality of stator vanes rotatably connected to the annular stator vane first platform and the annular stator vane second platform.

* * * * *